US009939137B2

(12) United States Patent
Shields et al.

(10) Patent No.: US 9,939,137 B2
(45) Date of Patent: Apr. 10, 2018

(54) FOLDABLE UTILITY LIGHTING

(71) Applicant: 2C Products, LLC, Port Orange, FL (US)

(72) Inventors: Thomas John Shields, Port Orange, FL (US); Tristan Mullane, Port Orange, FL (US)

( * ) Notice: Subject to any disclaimer, the term of this patent is extended or adjusted under 35 U.S.C. 154(b) by 22 days.

(21) Appl. No.: 14/887,321

(22) Filed: Oct. 19, 2015

(65) Prior Publication Data

US 2017/0108201 A1 Apr. 20, 2017

Related U.S. Application Data

(60) Provisional application No. 62/065,212, filed on Oct. 17, 2014.

(51) Int. Cl.

| | |
|---|---|
| ***F21V 1/06*** | (2006.01) |
| ***F21V 21/14*** | (2006.01) |
| ***F21V 31/00*** | (2006.01) |
| ***F21V 23/06*** | (2006.01) |
| *F21Y 105/10* | (2016.01) |
| *F21Y 115/10* | (2016.01) |
| *F21Y 107/70* | (2016.01) |

(52) U.S. Cl.

CPC ..... *F21V 21/145* (2013.01); *F21V 23/06* (2013.01); *F21V 31/005* (2013.01); *F21Y 2105/10* (2016.08); *F21Y 2107/70* (2016.08); *F21Y 2115/10* (2016.08)

(58) Field of Classification Search

CPC ..... F21V 1/06; F21V 11/00; F21V 21/145; F21V 31/00; F21Y 2105/16

See application file for complete search history.

(56) References Cited

U.S. PATENT DOCUMENTS

| | | | | |
|---|---|---|---|---|
| 5,848,830 | A * | 12/1998 | Castle | A47G 27/0243 362/253 |
| 8,172,426 | B2 * | 5/2012 | Frey | G02F 1/133305 362/217.16 |
| 8,529,106 | B2 * | 9/2013 | Jung | G09F 7/002 359/459 |
| 8,704,448 | B2 * | 4/2014 | Tischler | H05B 33/0821 315/185 R |
| 8,770,816 | B2 * | 7/2014 | Parker | F21S 2/005 362/608 |
| 9,068,720 | B2 * | 6/2015 | Mangus | F21V 15/01 |
| 9,345,925 | B2 * | 5/2016 | Liu | A63B 21/4037 |
| 9,651,230 | B1 * | 5/2017 | Girolami | F21V 21/145 |
| 2011/0254470 | A1 * | 10/2011 | Penoyer | F21S 2/005 315/313 |
| 2014/0268777 | A1 * | 9/2014 | Saydkhuzhin | F21V 21/14 362/249.04 |
| 2014/0362575 | A1 * | 12/2014 | Shirilla | F21V 21/145 362/249.08 |
| 2014/0369033 | A1 * | 12/2014 | Palfreyman | F21V 21/14 362/183 |
| 2016/0025311 | A1 * | 1/2016 | Tischler | H05K 1/00 362/232 |

* cited by examiner

*Primary Examiner* — Peggy Neils

(74) *Attorney, Agent, or Firm* — Lori J. Sandman

(57) ABSTRACT

This invention relates to a light system for use in indoor or outdoor environments. More specifically, it provides a foldable, portable, self-supporting shadow-reducing utility light system capable of illuminating multi-dimensional areas, a kit and a method of use therein.

10 Claims, 6 Drawing Sheets

FOLDABLE UTILITY LIGHTING

CROSS-REFERENCE TO RELATED APPLICATIONS

This application claims priority to U.S. Provisional Application 62/065,212 filed Oct. 17, 2014.

STATEMENT REGARDING FEDERALLY SPONSORED RESEARCH/DEVELOPMENT

Not applicable.

REFERENCE TO SEQUENCE LISTING, A TABLE, OR COMPUTER PROGRAM LISTING COMPACT DISC APPENDIX

Not applicable.

BACKGROUND OF THE INVENTION

This invention relates to a light system for use in indoor or outdoor environments. More specifically, it provides a foldable, portable, shadow-reducing utility light system capable of illuminating multi-dimensional areas, a kit and a method of use therein.

BRIEF SUMMARY OF THE INVENTION

The invention described herein comprises a portable, flexible, foldable sheet or mat that incorporates multiple individual light points for illumination in a variety of environments. In the preferred embodiment, it comprises Light Emitting Diodes (LEDs) arranged specifically in a format to illuminate an area and reduce shadows; Ultraviolet (UV) lights or other light-emitting systems are also contemplated. The light sheet or mat is made of a durable, flexible and sturdy material and can be worn, hung vertically or horizontally, laid on a surface, or be used in a free-standing posture to provide lighting in any desired environment in any desired direction. The invention is powered using either a transformer or connection via a charged power source, including but not limited to stored solar power. The circuitry for the light system is contained between protective material that provides additional functionality for further protection and support through utilization of semi-rigid sections of foam or other sturdy and flexible material. Additional cross members may be added to further support the invention for use in a free-standing posture.

Compact and/or portable lighting presently available includes hand held devices, those capable of suspension by various means, or free-standing mounted lights supported by poles or rigid upright members. They are generally either battery powered or plugged into common sources of alternating current. Limitations in the present art include an inability to be both flexible and self-supporting, requiring that they be held or attached to another object or surface, and a reliance on a single type of power supply. The present invention allows for a foldable, flexible and self-supporting light that can be powered by multiple power sources.

Another advantage over prior art includes the reduction or elimination of shadows generally resulting from traditional lighting sources. In one embodiment, the device configuration utilizes positioning of the light points in a regular and defined array and may optionally include reflective backing, which serves to project light in multiple directions and dimensions, thereby removing undesirable optical effects such as, but not limited to, shadowing from the illuminated area. Therefore, as a functional work or utility light, the light sheet or mat can be used to illuminate a broader surface than traditional lighting while providing a substantial elimination of shadows which obscure the overall viewability of the illuminated area.

A proposed use and specific advantage of this invention includes its application in automobile, boat, motorcycle or other vehicle mechanic or maintenance utilities. When working on engines or other internal vehicle components, for example working on an engine, the three-dimensional nature of the surfaces of the various components renders shadows that can be problematic in diagnostics, maintenance or repair. The present invention overcomes this problem by reducing the shadowing that occurs with currently available lighting systems. This feature is also particularly practical for use in operating rooms, medical practices or practitioners' offices where depth of view is critical.

All patents, patent applications, provisional patent applications and publications referred to or cited herein are incorporated by reference in their entirety to the extent they are not inconsistent with the teachings of the specification.

DESCRIPTION OF THE REFERENCE NUMBERS AND LETTERS

10 Flexible body membrane
20 Pocket containing the light source
30 Transparent membrane
40 Interstitial material
50 Connective circuitry
60 Retention clips
80 Accessory pocket
90 Fold seams

DESCRIPTION OF THE FIGURES IN THE DRAWINGS

FIGS. 4 and 5 illustrate an embodiment with an optional serial connection cable.

FIG. 6 is a line drawing showing a view of a third side of the foldable utility lighting.

FIG. 7 is a line drawing showing a view of a fourth side of the foldable utility lighting.

DETAILED DESCRIPTION

Figure 1:
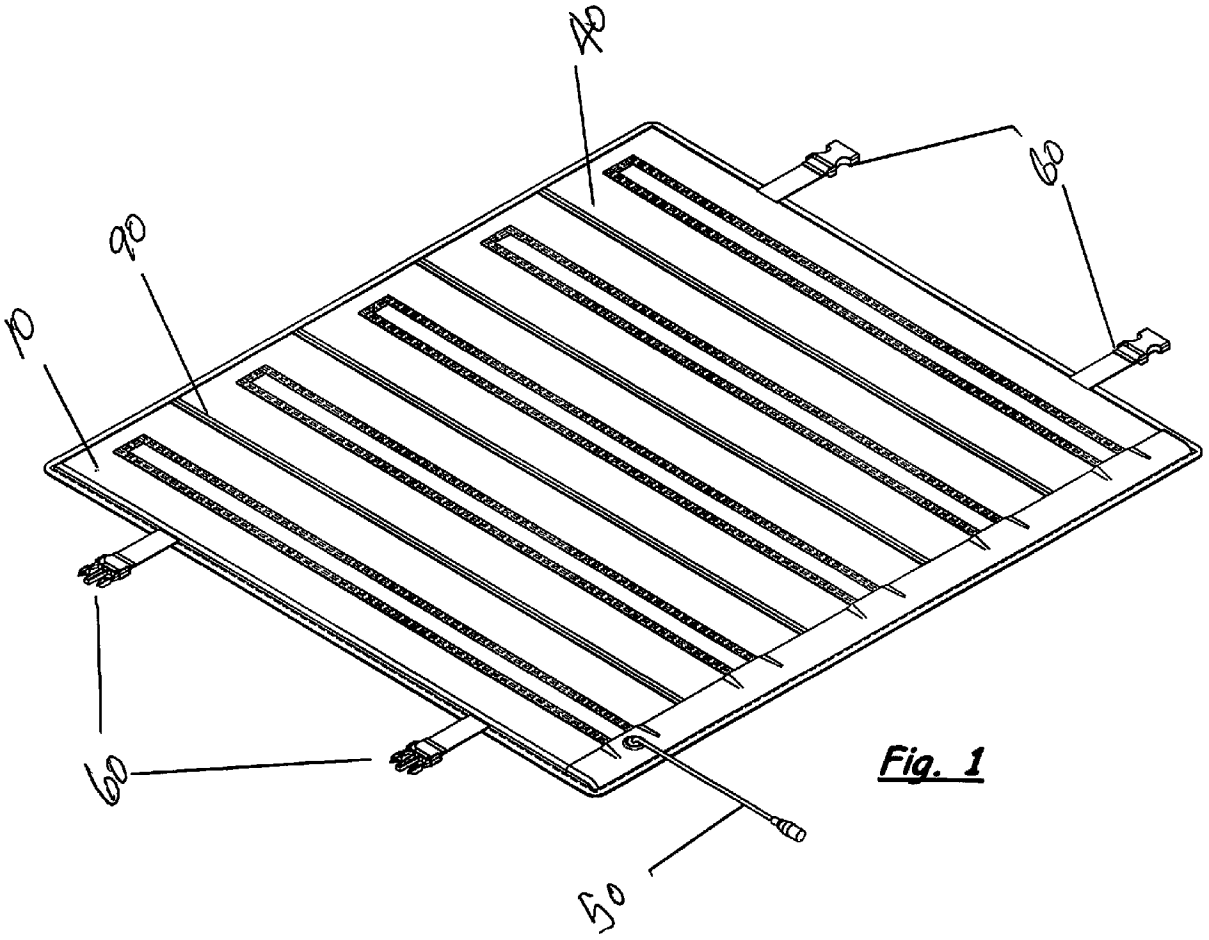
FIG. 1 is a line drawing showing a perspective front view of the claimed foldable utility lighting.
Figure 2:
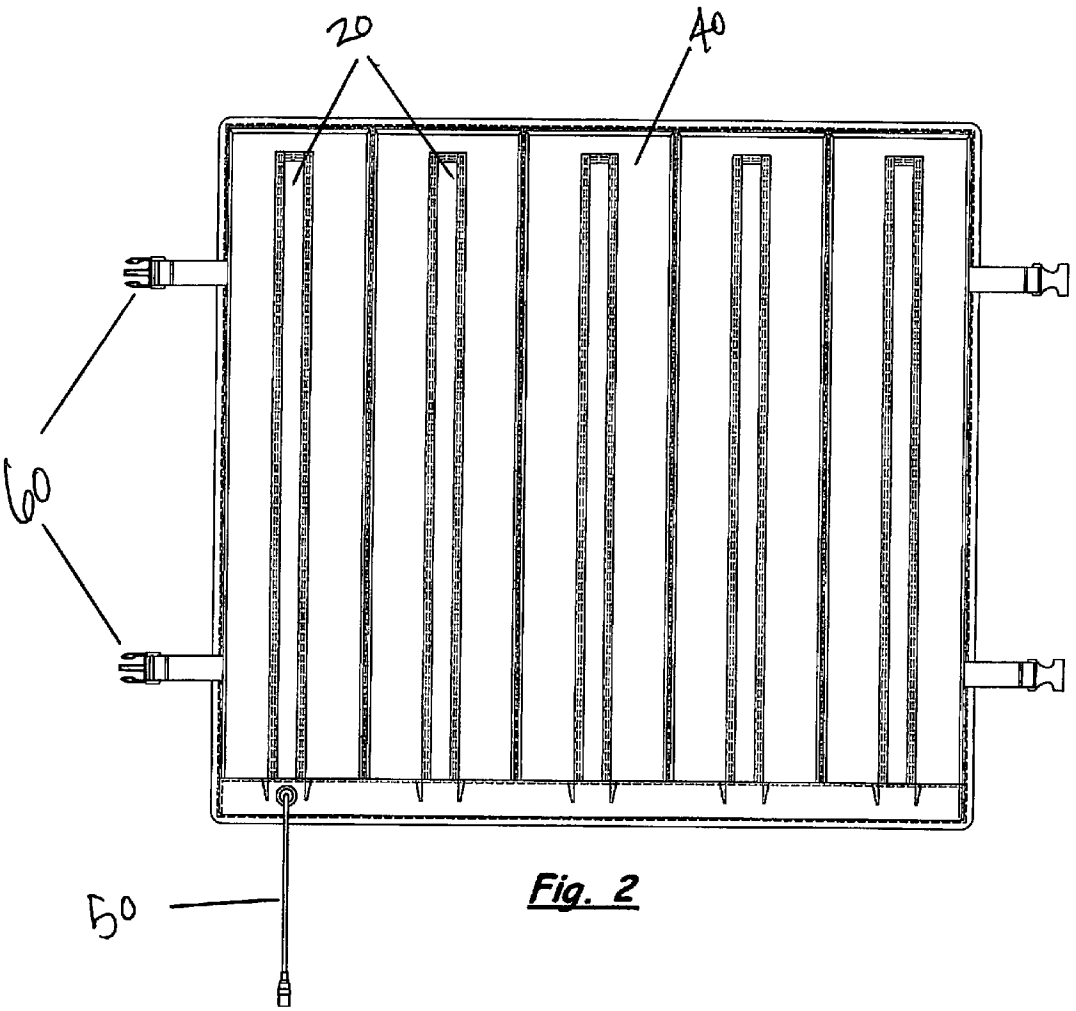
FIG. 2 is a line drawing showing a view of the front of the claimed foldable utility lighting.

The present article is represented by the perspective view of a preferred embodiment in FIG. 1. The embodiment of the article depicted in this figure utilizes a strips of LED or UV lights arranged in arrays or patterns within or upon a flexible body membrane 10, which are enclosed within transparent areas, or pockets containing the light source 20, in the flexible body membrane 10. The light strips in a preferred embodiment include a plurality of individual lights placed in arrays in rows to optimize shadow reduction. In embodiments with one transparent side, the light wash can be up to 140 degrees, allowing for excellent visual resolution of articles in multi-dimensional settings. If both sides are transparent, light can extend in 360 degrees. In this depicted embodiment, rows of arrayed lights are shown alternating with, between or mounted on top of areas for interstitial material 40, which serves to protect and cushion the lights from the user and other possible harm. Optional and removable supports which can have feet to support the light upright, can be positioned within pockets within or between sheets of the flexible body membrane 10. The rows of lights, interstitial material 40 and support members are secured within a pocket of flexible water, weather and particle resistant material forming the flexible body membrane 10 to protect the lighting from weather and elements that could compromise the lights or their power source. In a preferred embodiment, LED lighting is connected through a positive terminal and negative terminal. One skilled in the art would recognize that illumination can be provided by various sources and is not limited to LED, but could include UV or other light sources.

Figure 3:
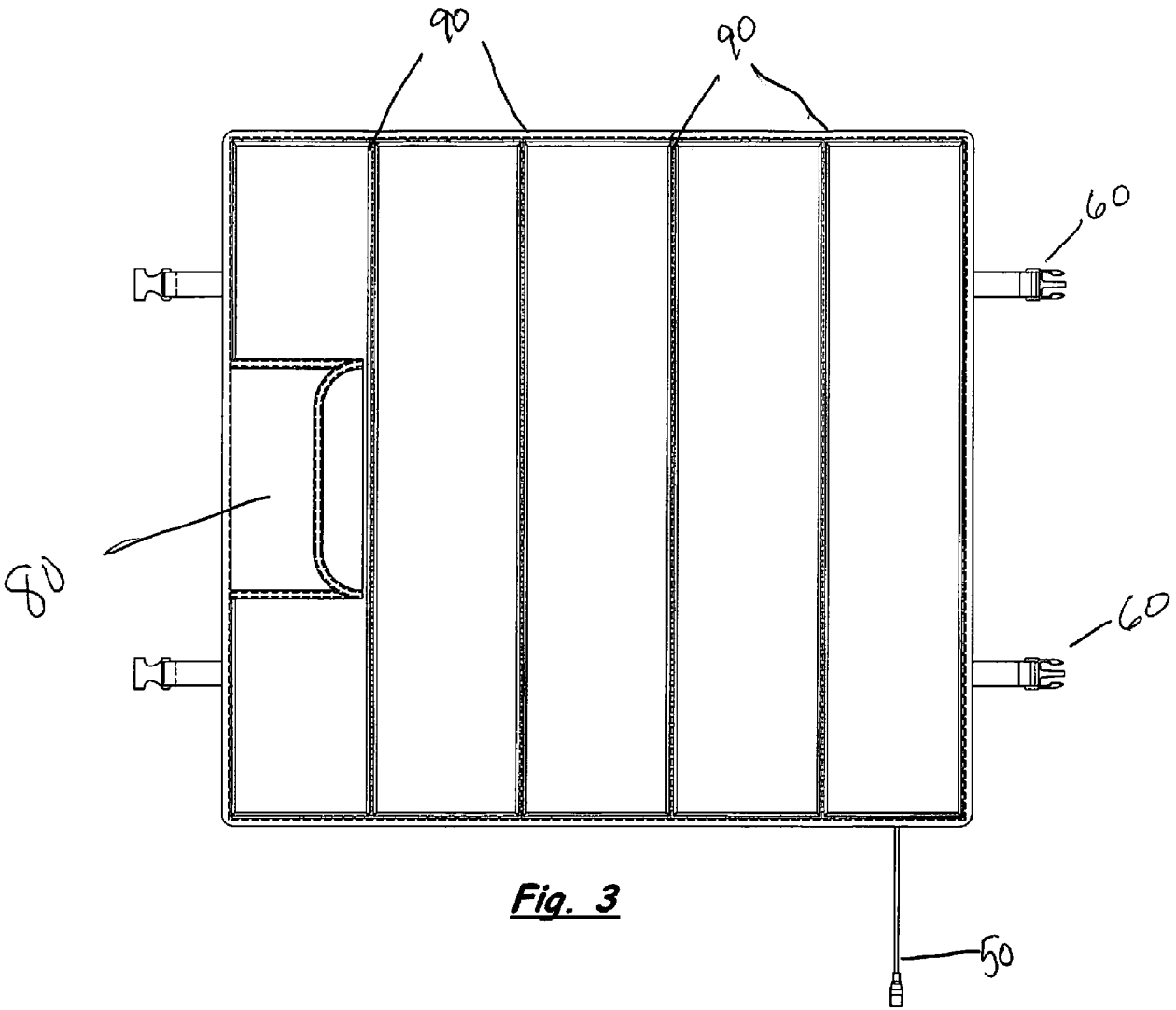
FIG. 3 is a line drawing showing a view of the back of the foldable utility lighting and illustrating a utility pocket.

FIG. 3 shows an embodiment of the back of the light mat. Fold seams 90 are seen; this is where one or more surfaces of the flexible body membrane 10 are sewn, glued, heat-sealed or otherwise bonded to create pockets containing the light source, interstitial material 40 or optional supports. An accessory pocket 80 is also shown, for keeping power chords, battery clips, or attachment means. The light mat can be self-standing if using the optional supports, but can also be attached via a range of attachment means, to surfaces, upright components of objects, people or structures to direct light in any desired path or wash. Various attachment means are contemplated, including grommets, straps, stays, clips, magnets, flexible twisting components, or other physical or mechanical means.

Figure 8:
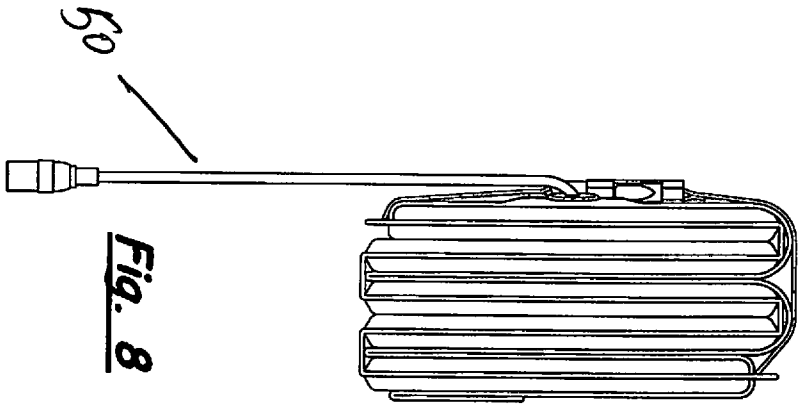
FIG. 8 is a line drawing showing a view of the foldable utility lighting in its folded configuration.
Figure 9:
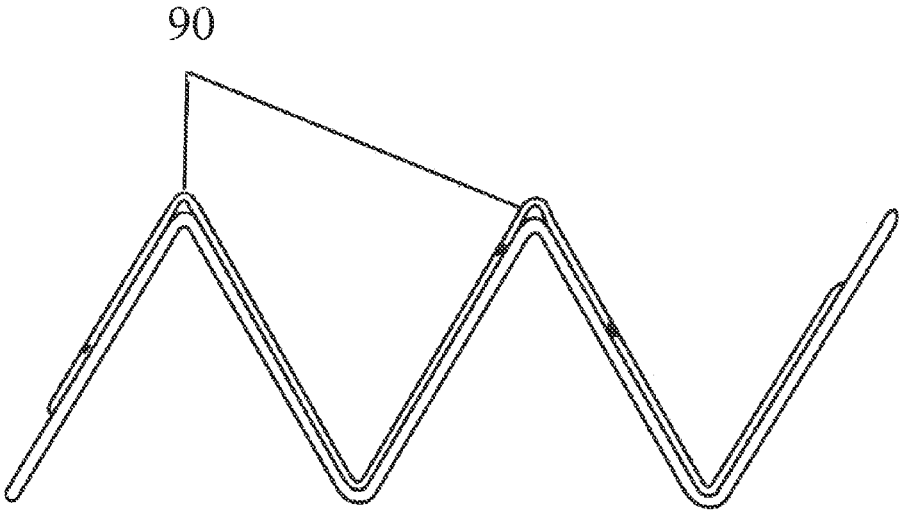
FIG. 9 is a line drawing illustrating one embodiment of the foldability feature of the foldable utility lighting.

The claimed flexible utility lighting has a large length/width to height ratio as seen in FIGS. 4-7, rendering it relatively flat to enhance storage capability and portability. In one embodiment, clear, transparent or translucent vinyl or flexible plastic is used in the pocket containing the light source 20 and integrated with water- and weather-resistant nylon, canvas, polymeric or other flexible material. Fire retardant and non-slip materials can also be incorporated. Furthermore, the rows can be folded upon each other in a bi-fold, tri-fold, or accordion fashion as seen in FIGS. 8 and 9 to allow convenient storage and portability while still allowing for a desired level of rigidity. In another embodiment, the flexible membrane on the pocket containing the light source 20 is opaque, with spacing and array layout that lends to specific illumination applications, whether the desired application is a uniform illumination of desired space or directionally specific illumination.

Figure 4:
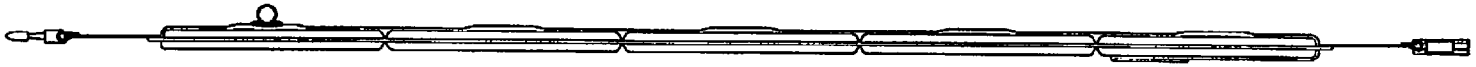
FIGS. 4 through 7 are line drawings showing views of the foldable utility lighting from each of the four sides.
Figure 5:
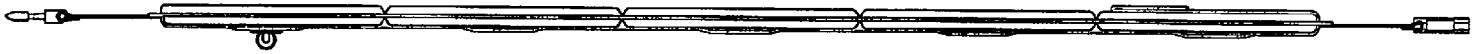
Figure 6:
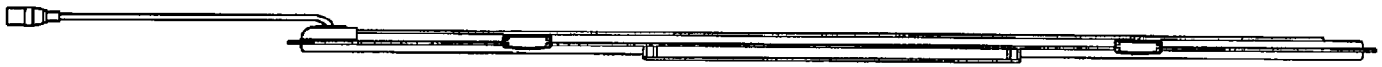
Figure 7:
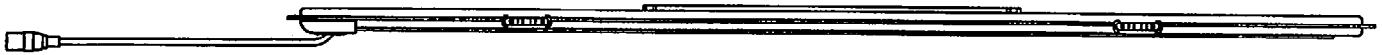

Another distinguishing feature of the present invention is its inter-connectability. In one embodiment, pin connectors in the form of branches connected to the connector circuitry 50 and/or positive and negative terminals can join a plurality of individual light sheets or mats to extend and expand illumination capacity. This is seen in FIGS. 4 and 5. The invention can also include a dimmable function, enabling the capability to modify light intensity.

Power sources for the invention can include but are not limited to one or more of the following sources:

a. Automotive—12 volt power outlet/lighter socket
b. Alligator clips direct to vehicle battery
c. 12 volt transformer to household current
d. Rechargeable battery pack
e. Solar power cells FIG. 9 is a line drawing illustrating one embodiment of the foldability feature of the foldable utility lighting, wherein the folding is accomplished by laying portions of the light mat upon itself by flexibly bending it at the fold seams 90 or other areas between light pockets, or support or interstitial areas 40. It is then held together in the folded configuration with retention clips 60.

The foldable utility light disclosed herein is also contemplated as a kit, comprising the foldable utility light, its chords and cables for connecting it to a power supply, and other optional accessories such as an optional portable power supply battery contained within a carrying bag.

Additionally, a method of lighting, is disclosed. The method includes the steps of:

a. Removing the portable, flexible utility light from its carrying bag;
b. Unfolding the utility light;
c. Inserting desired number of removeable support members and positioning them in pockets or areas within a sheet or between multiple sheets of flexible, water- and weather-resistant body membrane;
d. Connecting the light to a power supply;
e. Positioning the light mat by connecting via attachment means comprising grommets, straps, stays, clips, magnets, flexible twisting components or other physical or mechanical means to attach said light mat to surfaces or upright components of objects, people, or structures;
f. Shining or directing light to area where illumination is desired;
g. Optionally interconnecting multiple said light pads to extend and expand lighting capacity;
h. Disconnecting from said power supply, folding and replacing said light mat into said carrying bag.

While the description above discloses preferred embodiments of the present invention, it is contemplated that numerous variations and modifications of the invention are possible and are considered to be within the scope of the claims that follow.

The invention claimed is:

1. A portable, flexible, foldable light mat comprising:

a. a semi-rigid, cushioned body membrane, further comprising one or more sheets of flexible, durable, water- and weather-resistant vinyl, nylon, canvas, polymeric material or fabric with a top and a bottom surface and at least two opposing ends, and further comprising pockets located between said top and said bottom surfaces and said opposing ends that contain and position semi-rigid interstitial material;
b. Interstitial material comprising semi-rigid foam with sufficient flexibility to allow folding and cushioning of objects and the light mat components;
c. a power source connected with the device to activate at least one light source;
d. At least one light source;
e. Water- and weather resistant enclosed areas mounted upon said body membrane further comprising the at least one light source; and
e. flexibly mounted clips to removably secure the device in a folded, upright or mounted position, such that when the mat is in a folded upright position the device operates as a self-supporting free standing lighting device.

2. The portable, flexible, foldable light mat of claim 1 wherein the one or more sheets of flexible, durable, water- and weather-resistant nylon, canvas, polymeric material or fabric are at least one of sewn, glued, sealed or bonded to create pockets that contain and position the interstitial material.

3. The portable, flexible, foldable light mat of claim 1 wherein said at least one light source comprises light emitting diode (LED) or ultraviolet (UV) lights in regularly spaced light arrays; said arrays are positioned within the enclosed areas in a configuration to optimize shadow reduction and protect said lights from water, weather and physical damage.

4. The portable, flexible, foldable light mat of claim 1 wherein said enclosed areas are partially or completely transparent, translucent or opaque to facilitate light passage, and have been at least one of sewn, glued, heat sealed or bonded to transparent, translucent or opaque water and heat resistant material to create the enclosed areas for enclosing the at least one light source.

5. The portable, flexible, foldable light mat of claim 3 wherein said light arrays are secured within pockets or enclosed areas and are spaced in parallel configuration to assure light spray delivery of at least about 140 degrees and can deliver light spray of up to 360 degrees when the device is positioned upright with opposing ends located proximally to each other.

6. The portable, flexible, foldable light mat of claim 1 wherein the interstitial material comprises foam, sponge, rubber, silicon or similarly flexible material with sufficient strength to maintain and support the device in a semi-rigid and upright configuration and sufficient flexibility to cushion and thereby protect the at least one light source.

7. The portable, flexible, foldable light mat of claim 1 wherein said water and weather-resistant body membrane further comprises a configuration including:

a. A first sheet of water- and weather-resistant nylon, canvas, polymeric or fabric material with a first surface and a second surface;

b. A second sheet of water- and weather-resistant nylon, canvas, polymeric or fabric material with a first surface and a second surface;

c. Said first sheet and said second sheet are attached by folding, stitching, seams, glue, adhesive or physical fusion to create; water- and weather-resistant spaces for said light sources and said interstitial materials.

8. The portable, flexible, foldable light mat of claim 1 wherein the power source further comprises standard chords or cables for connecting said light mat to the power source, including but not limited to battery terminal clips, standard electrical outlet chords, inside car battery connections including lighter or portable phone cable ports, or solar power connection cables; interconnection cables for connecting multiple individual light mats together to extend and expand lighting capacity; and an optional secondary battery or backup power supply.

9. The portable, flexible, foldable light mat of claim 1 further comprising flexible fold seams between the pockets or enclosed areas, wherein folding is accomplished by laying portions of said light mat upon itself by flexibly bending at the fold seams between the pockets of interstitial material or enclosed areas in bi-fold, tri-fold or accordion fashion.

10. A kit comprising:

a. The portable, flexible, foldable light mat of claim 1;

b. A portable carrying bag for said light mat and component parts;

c. Standard chords or cables for connecting said portable, flexible, foldable light mat to one or more power sources, including battery terminal clips, standard electrical outlet chords, inside car battery port connection cables, or solar power connection cables;

d. interconnection cables for connecting multiple individual light mats together to extend and expand lighting capacity; and e. A secondary battery or portable power supply.

* * * * *